US005693153A

United States Patent [19]

Rosengard

[11] Patent Number: 5,693,153

[45] Date of Patent: Dec. 2, 1997

[54] NON-CHROMATED SURFACE PREPARATION MATERIALS AND METHODS FOR CORROSION PROTECTION OF ALUMINUM AND ITS ALLOYS

[75] Inventor: Jordan L Rosengard, Woodland Hills, Calif.

[73] Assignee: He Holdings, Inc.,, Los Angeles, Calif.

[21] Appl. No.: 754,374

[22] Filed: Nov. 21, 1996

[51] Int. Cl.[6] ..... C23C 22/56

[52] U.S. Cl. ..... 148/272; 148/273; 148/275

[58] Field of Search ..... 148/272–275

[56] References Cited

U.S. PATENT DOCUMENTS 4,711,667 12/1987 Bibber ..... 148/272

5,192,374 3/1993 Kindler ..... 148/272

*Primary Examiner*—Sam Silverberg

*Attorney, Agent, or Firm*—M. E. Lachman; M. W. Sales; W. K. Denson-Low

[57] ABSTRACT

Surface preparation methods and materials that provide corrosion protection for aluminum and its alloys without the use of chromate and that protects aluminum surfaces against corrosion nearly as well as a chromate conversion coating. In accordance with the present methods, aluminum parts are degreased in a general purpose cleaner and rinsed in hot tap water. The parts are then cleaned using alkaline cleaner and then rinsed in cold tap water. The parts are then deoxidized using one of two alternative steps. The parts may be deoxidized using a 20–25 volume percent Smut-Go NC solution at room temperature for 15–25 minutes. The parts may alternatively be deoxidized using a solution of 10% $HNO_3$ and 3% $NaBrO_4$ dissolved in water at room temperature for 15–25 minutes. The deoxidized aluminum parts are then rinsed in cold tap water. The parts are then immersed in boiling deionized water and then sealed using a 1% $LiNO_3$, 10% $Al(NO_3)_3$ and 10% aluminum silicate solution. The sealed parts are sealed a second time using a solution of 13–15% Kasil #1 with a dissolved corrosion inhibitor. The sealed parts are finally dried in air for about 24 hours or in an oven for 3–4 hours at 150 degrees Fahrenheit. Aluminum parts treated by the present methods meet the requirements of MIL-C-5541 without using hazardous chemicals.

12 Claims, 1 Drawing Sheet

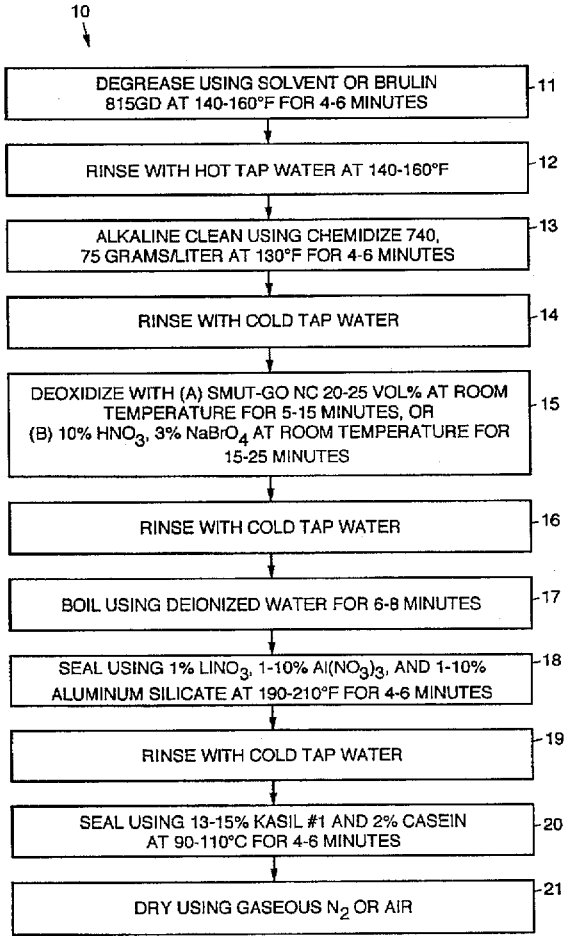

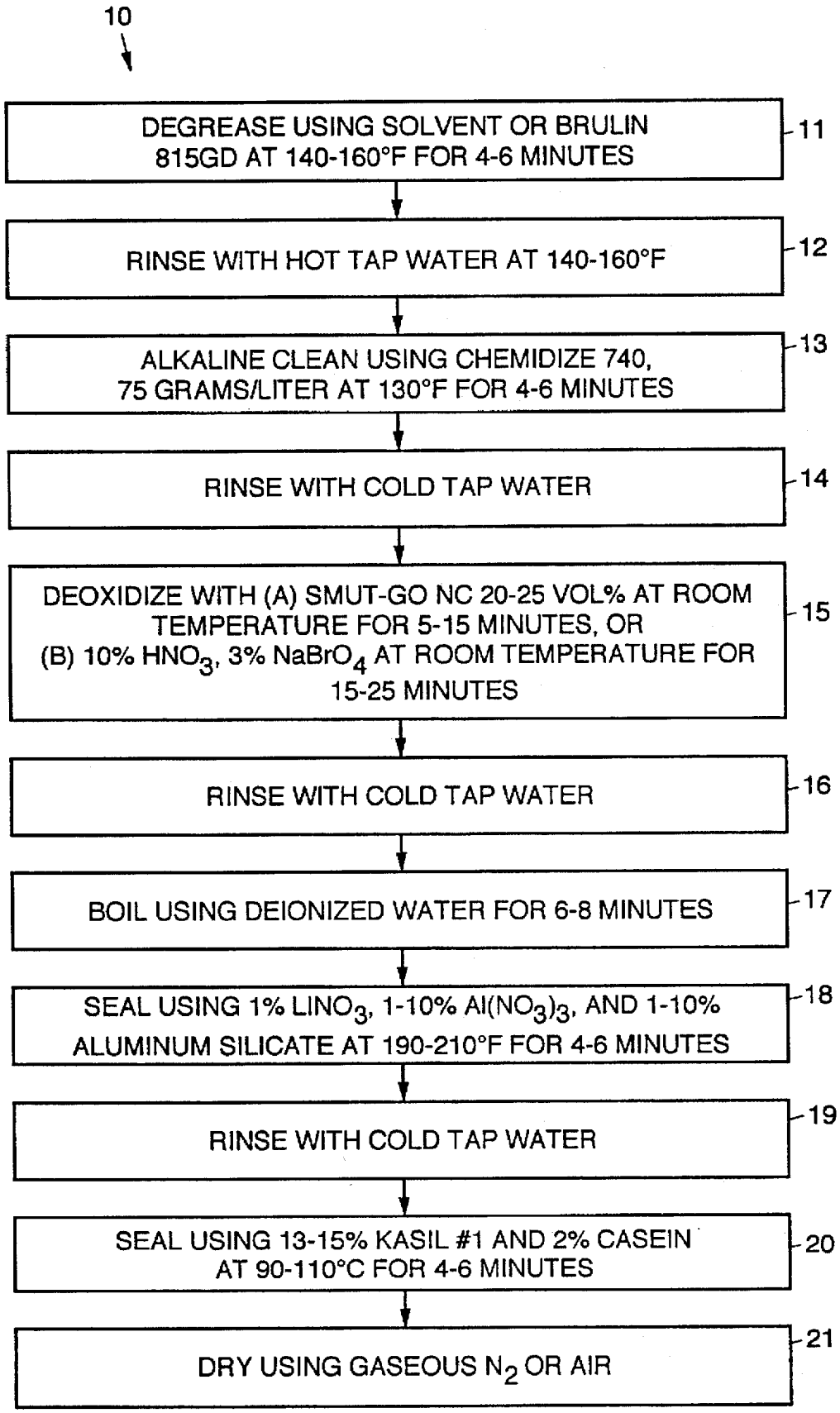
10
DEGREASE USING SOLVENT OR BRULIN 815GD AT 140-160°F FOR 4-6 MINUTES
11
RINSE WITH HOT TAP WATER AT 140-160°F
12
ALKALINE CLEAN USING CHEMIDIZE 740, 75 GRAMS/LITER AT 130°F FOR 4-6 MINUTES
13
RINSE WITH COLD TAP WATER
14
DEOXIDIZE WITH (A) SMUT-GO NC 20-25 VOL% AT ROOM TEMPERATURE FOR 5-15 MINUTES, OR (B) 10% $HNO_3$, 3% $NaBrO_4$ AT ROOM TEMPERATURE FOR 15-25 MINUTES
15
RINSE WITH COLD TAP WATER
16
BOIL USING DEIONIZED WATER FOR 6-8 MINUTES
17
SEAL USING 1% $LINO_3$, 1-10% $Al(NO_3)_3$, AND 1-10% ALUMINUM SILICATE AT 190-210°F FOR 4-6 MINUTES
18
RINSE WITH COLD TAP WATER
19
SEAL USING 13-15% KASIL #1 AND 2% CASEIN AT 90-110°C FOR 4-6 MINUTES
20
DRY USING GASEOUS $N_2$ OR AIR
21

NON-CHROMATED SURFACE PREPARATION MATERIALS AND METHODS FOR CORROSION PROTECTION OF ALUMINUM AND ITS ALLOYS

BACKGROUND

The present invention relates generally to processing materials and methods relating to aluminum and its alloys, and more particularly, to non-chromated surface preparation materials and methods that provide for corrosion protection of aluminum and its alloys.

Surface treatments based on hexavalent chromium have been widely used for many years to protect aluminum and other metal parts from corrosion, and to provide a base for painting or adhesive bonding. Unfortunately, hexavalent chromium is high on the list of hazardous chemicals targeted for elimination from manufacturing operations by the Environmental Protection Agency. Despite on-going efforts around the world to find non-hazardous replacements, none can yet match the full range of benefits offered by chromate-based treatments. In particular, none can match the intrinsic corrosion resistance achieved by chromate conversion coatings.

U.S. Pat. No. 5,192,374 entitled "Chromium-free Method and Composition to Protect Aluminum", assigned to the assignee of the present invention eliminates some of the problems associated with hexavalent chromium compositions by providing a corrosion resistant coating composition which contains no chromium or other similar toxic materials. This method provides a corrosion resistant coating for aluminum or aluminum alloy surface that can withstand a salt fog environment and that provides an intermediate protective coating. This patent discusses a process disclosed in U.S. Pat. No. 4,711,667, entitled "Corrosion Resistant Aluminum Coating", which will be discussed below.

U.S. Pat. No. 4,711,667 discloses a process that eliminates the use of chromium, which involves coating aluminum surfaces with a film of aluminum oxhydroxide (pseudo boehmite). This process yields a coating that is not as conductive as a chromate conversion coating, but is also not an insulator. In addition, its corrosion resistance is not as good as that produced by chromate conversion. The details of this process are discussed below.

More specifically, U.S. Pat. No. 4,711,667 discloses treating a 2024-T3 aluminum alloy coupon having dimensions of 3 inches by 10 inches (7.6 cm by 25.4 cm), using the following steps. The first step is to clean the aluminum alloy coupon in an alkaline cleaner, such as Chemidize 740 (available from the Allied Kelite Division of the Witco Chemical Corporation) at 71° Celsius for 3 minutes. In step 2, the coupon is rinsed for 1 minute using deionized water. In step 3, the coupon is deoxidized at 30°–35° Celsius for 20 minutes in a mixture of 10% nitric acid and 3% sodium bromate. In step 4, the coupon is rinsed for 1 minute in deionized water. In step 5, the coupon is placed in deionized water at 97° Celsius to 100° Celsius for 5 minutes.

In step 6, the coupon is placed in a solution of 1% lithium nitrate and 1% aluminum nitrate at 97°–100° Celsius for minutes. In step 7, the coupon is rinsed in deionized water. In step 8, the coupon is placed in solution of 0.25% $KMNnO_4$ for 5 minutes at 57°–60° Celsius. In step 9, the coupon is rinsed in deionized water. In step 10, the coupon is placed in solution of 10% potassium silicate at 90°–95° Celsius for 1–1.5 minutes. In step 11, the coupon is rinsed in deionized water. In step 12, the coupon is dried using a blow dryer.

In a three-part systematic study of non-hazardous alternatives to chromate conversion coatings undertaken by the assignee of the present invention, it was discovered that the benefits provided by known alternative processes could be achieved by using only the first three steps of those processes. The discovery regarding the use of these three steps formed the basis of a process disclosed in U.S. patent application Ser. No. 08/447,465, filed May, 23, 1995, and assigned to the assignee of the present invention. Unfortunately, none of the known alternative processes, including the process of the above-cited patent application, protects aluminum surfaces against corrosion nearly as well as a chromate conversion coating. The second and third steps of the study relate to the present invention, and will be discussed below.

In view of the above, it would therefore be an improvement in the art to have a method that provides for corrosion protection of aluminum and its alloys that protects aluminum surfaces against corrosion nearly as well as a chromate conversion coating. It would also be beneficial to improve upon the processes disclosed in U.S. patent application Ser. No. 08/447,465, and U.S. Pat. No. 4,711,667 discussed herein.

Accordingly, it is an objective of the present invention to provide for non-chromated surface preparation materials and methods that provide for corrosion protection of aluminum and its alloys.

SUMMARY OF THE INVENTION

To meet the above and other objectives, the present invention provides for chromate-free surface treatment methods for processing aluminum and its alloys that achieve corrosion-protection similar to that achieved by chromate conversion coatings. The present methods treat aluminum and its alloys to provide corrosion protection in the following way. Aluminum parts are degreased using a solvent. Degreasing may be accomplished using a general purpose cleaner such as Brulin 815GD at 140°–160° Fahrenheit for 4–6 minutes. The degreased parts are rinsed using hot tap water typically at 140°–160° Fahrenheit. The parts are then cleaned using an alkaline cleaner, such as Chemidize 740 (available from the Allied Kelite Division of the Witco Chemical Corporation) and then rinsed in cold tap water.

The parts are then deoxidized using one of two alternative steps. The parts may be deoxidized using a 20–25 volume percent Smut-Go NC solution (available from Turco Division of EIF Atochem North America Inc.) at room temperature for 15–25 minutes. Alternatively the parts may be deoxidized using a solution of 10% $HNO_3$ and 3% $NaBrO_4$ dissolved in water at room temperature for 15–25 minutes. The deoxidized parts are then rinsed with cold tap water.

The parts are then immersed in boiling deionized water, typically for about 6–8 minutes. The parts are then sealed using a 1% lithium nitrate ($LiNO_3$), 1–10% aluminum nitrate ($Al(NO_3)_3$) and 1–10% aluminum silicate solution. The first sealing step may be performed at 190°–210° Fahrenheit for 4–6 minutes. The parts are then sealed a second time using a solution of 13–15% Kasil #1 and a corrosion inhibitor (such as Casein, 2%). The second sealing step may be performed at 90°–110° Fahrenheit for 4–6 minutes. The sealed parts are finally air dried for about 24 hours or oven dried at 150 degrees Fahrenheit for 3–4 hours.

Aluminum parts that have received the present treatment methods can meet the corrosion requirements of MIL-C-5541 without the use of hazardous chemicals. Adopting the present surface treatment methods allows those who build or maintain aluminum equipment to maintain the highest standards of corrosion resistance while meeting legal obligations regarding elimination of hazardous waste.

While some chromate-free treatments, including that disclosed in U.S. patent application Ser. No. 08/447,465, can advantageously replace chromate undeflayers for paint, the present invention offers the first practical way to match the intrinsic corrosion resistance of chromate conversion coatings.

The present invention may be used in missiles, sensors, and radars, for example, that have exposed or painted aluminum surfaces. A small amount of cost savings (~5%), is provided using the present methods compared to existing chromate processes, reflecting a slightly shorter processing time. However, the main advantage provided by the present invention is the elimination of toxic and environmentally hazardous chromate materials from the process.

BRIEF DESCRIPTION OF THE DRAWINGS

The various features and advantages of the present invention may be more readily understood with reference to the following detailed description taken in conjunction with the accompanying drawing which shows a flow diagram illustrating methods in accordance with the principles of the present invention that employ non-chromated surface preparation materials that provide for corrosion protection of aluminum and its alloys.

DETAILED DESCRIPTION

In a second phase of the study, steps were added to the invention of the above-cited patent application to provide improved protection against corrosion. This series of process steps produced the present methods 10. A number of 2024-T3 aluminum panels treated with the improved method 10 of the present invention can survive a 168-hour exposure to salt fog with essentially no visible corrosion, meeting the criteria of MIL-C-5541 for chemical conversion processes.

A flow-chart of the present method 10 is shown in the drawing figure. In particular, the drawing figure shows a flow diagram illustrating various methods 10 in accordance with the principles of the present invention that employ non-chromated surface preparation materials that provide for corrosion protection of aluminum and its alloys. The present method 10 comprises the following steps.

Aluminum parts are degreased 11 using a general purpose cleaner such as Brulin 815GD at 140°–160° Fahrenheit for 4–6 minutes. The degreased aluminum parts are rinsed 12 with hot tap water at 140°–160° Fahrenheit. The rinsed and degreased aluminum parts are then cleaned 13 using alkaline cleaner, such as Chemidize 740, available from the Allied Kelite Division of the Witco Chemical Corporation, mixed at 75 grams per liter of water at 130° Fahrenheit for 4–6 minutes. The alkaline cleaned aluminum parts are rinsed 14 with cold tap water.

The aluminum parts are then deoxidized 15 using one of two alternative steps. The aluminum parts may be deoxidized **15*a* using a 20–25 volume percent Smut-Go NC solution at room temperature for 15–25 minutes. Alternatively the aluminum parts may be deoxidized 15*b* using a solution of 10% $HNO_3$ and 3% $NaBrO_4$ dissolved in water at room temperature for 15–25 minutes. The deoxidized aluminum parts are then rinsed 16** with cold tap water.

The deoxidized and rinsed aluminum parts are then immersed 17 in boiling deionized water for 6–8 minutes. The aluminum parts are then sealed 18 using a 1% lithium nitrate ($LiNO_3$), 1–10% aluminum nitrate ($Al(NO_3)_3$) and 1–10% aluminum silicate solution at 190°–210° Fahrenheit for 4–6 minutes. The sealed aluminum parts are then rinsed 19 is cold tap water. The aluminum parts are then sealed 20 a second time using a solution of 13–150% Kasil #1 and 2% Casein at 90°–110° Fahrenheit for 4–6 minutes. Kasil #1 is a potassium silicate and is available from the PQ Corporation. Kasil #1 comprises 8.30±0.20% by weight $K_2O$ and typically 20.75% $SiO_2$. The solution used in practicing the present invention comprised about 40 grams per liter of potassium silicate and about 20 grams of Casein. Finally the fully sealed aluminum parts are air or nitrogen dried 21 for about 24 hours or oven dried 21 at 150 degrees Fahrenheit for 3–4 hours.

A novel feature of the present methods is the use of Casein (milk protein) as part of the second sealer. Casein was used because of its known effectiveness as a pore-filler. However, it appears that Casein also serves as more than an inert pore filler in the present invention. Both chromate materials and organic nitrogen compounds (including proteins) are known to inhibit the corrosion of metals. Consequently, the Casein acts as a corrosion inhibitor. For this reason, other proteins and organic nitrogen compounds work in place of the Casein in the present method. Such proteins and organic nitrogen compounds include proteins and Casein, for example.

In a third phase of the above-mentioned study, the viability of using the present method 10 in a production setting was established. Panels of several aluminum alloys (2024-T3, 6061-T6 and 7075-T6) were treated using the method 10 in production tanks at a manufacturing facility of the assignee of the present invention. Panels made of 2024-T3 and 7075-T6 aluminum alloy consistently passed the 168-hour salt fog test. Surprisingly, panels of 6061-T6 (normally a more corrosion resistant alloy than 2024-T3 or 7075-T6) required slightly modified processing (15–25 minutes in the Smut-Go deoxidizer versus 20 minutes in the nitric acid-sodium bromate deoxidizer) before they could pass the 168 hour salt fog test.

Thus, non-chromated surface preparation materials and methods that provide for corrosion protection of aluminum and its alloys have been disclosed. It is to be understood that the described embodiments are merely illustrative of some of the many specific embodiments which represent applications of the principles of the present invention. Clearly, numerous and varied other arrangements may be readily devised by those skilled in the art without departing from the scope of the invention.

What is claimed is:

1. A method of providing corrosion protection of aluminum and its alloys comprising the steps of:

degreasing aluminum parts using a general purpose cleaner at a predetermined elevated temperature for a predetermined time period;

rinsing the degreased aluminum parts using hot tap water at a predetermined elevated temperature;

cleaning the rinsed and degreased aluminum parts using alkaline cleaner at a predetermined elevated temperature for a predetermined time period;

rinsing the cleaned aluminum parts using cold tap water;

deoxidizing the aluminum parts;

rinsing the deoxidized aluminum parts with cold tap water;

immersing the deoxidized and rinsed aluminum parts in boiling deionized water for a predetermined time period;

sealing the boiled aluminum parts using a predetermined lithium nitrate, aluminum nitrate and aluminum silicate solution at a predetermined elevated temperature for a predetermined time period;

sealing the aluminum parts a second time using a solution of potassium silicate and a corrosion inhibitor comprising Casein at a predetermined elevated temperature for a predetermined time period; and drying the sealed aluminum parts.

2. The method of claim 1 wherein the step of degreasing the aluminum parts comprises degreasing the aluminum parts using Brulin 815GD.

3. The method of claim 1 wherein the step of degreasing the aluminum parts is performed at a temperature from 140°–160° Fahrenheit for 4–6 minutes.

4. The method of claim 1 wherein the aluminum parts are rinsed using hot tap water at a temperature from 140°–160° Fahrenheit.

5. The method of claim 1 wherein the rinsed and degreased aluminum parts are cleaned using Chemidize 740 mixed at 75 grams per liter of water at 130° Fahrenheit for 4–6 minutes.

6. The method of claim 1 wherein the step of deoxidizing the aluminum parts comprises the step of:

deoxidizing-the aluminum parts using a 20–25 volume percent Smut-Go NC solution at room temperature for 15–25 minutes.

7. The method of claim 1 wherein the step of deoxidizing the aluminum parts comprises the step of:

deoxidizing the aluminum parts using a solution of 10% $HNO_3$ and 3% $NaBrO_4$ dissolved in water at room temperature for 15–25 minutes.

8. The method of claim 1 wherein the step of immersing the deoxidized aluminum parts comprises the step of:

immersing the deoxidized and rinsed aluminum parts in boiling deionized water for 6–8 minutes.

9. The method of claim 1 wherein the first step of sealing the boiled aluminum parts comprises the step of:

sealing the boiled aluminum parts using a 1% lithium nitrate ($LiNO_3$), 1–10% aluminum nitrate ($Al(NO_3)_3$) and 1–10% aluminum silicate solution at 190°–210° Fahrenheit for 4–6 minutes.

10. The method of claim 1 wherein the step of sealing the aluminum parts a second time comprises the step of:

sealing the aluminum parts using a solution of 13–15% Kasil and 2% Casein at 90°–110° Fahrenheit for 4–6 minutes.

11. The method of claim 1 wherein the step of drying the sealed aluminum parts comprises the step of:

air drying the sealed aluminum parts for about 24 hours.

12. The method of claim 1 wherein the step of drying the sealed aluminum parts comprises the step of:

oven drying the sealed aluminum parts at about 150 degrees Fahrenheit for 3–4 hours.

* * * * *